US006505926B1

(12) United States Patent
Trafton et al.

(10) Patent No.: US 6,505,926 B1
(45) Date of Patent: Jan. 14, 2003

(54) INK CARTRIDGE WITH MEMORY CHIP AND METHOD OF ASSEMBLING

(75) Inventors: R. Winfield Trafton, Brockport, NY (US); James S. Newkirk, LeRoy, NY (US); Scott C. Robinson, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/931,521

(22) Filed: Aug. 16, 2001

(51) Int. Cl.[7] ..... B41J 2/175
(52) U.S. Cl. ..... 347/86
(58) Field of Search ..... 347/85, 86, 87, 347/19, 50

(56) References Cited

U.S. PATENT DOCUMENTS

| | | | | |
|---|---|---|---|---|
| 4,961,088 A | | 10/1990 | Gilliland et al. | 399/25 |
| D341,157 S | | 11/1993 | Kitahara et al. | D18/56 |
| 5,266,968 A | | 11/1993 | Stephenson | 347/172 |
| 5,410,641 A | | 4/1995 | Wakabayashi et al. | 358/1.13 |
| 5,506,611 A | | 4/1996 | Ujita et al. | 347/86 |
| 5,610,635 A | | 3/1997 | Murray et al. | 347/7 |
| 5,666,146 A | | 9/1997 | Mochizuki et al. | 347/86 |
| 5,788,388 A | | 8/1998 | Cowger et al. | 400/703 |
| 5,835,817 A | | 11/1998 | Bullock et al. | 399/25 |
| 5,860,363 A | | 1/1999 | Childers et al. | 101/483 |
| 5,956,057 A | | 9/1999 | Childers et al. | 347/49 |
| 6,000,773 A | | 12/1999 | Murray et al. | 347/7 |
| 6,019,449 A | | 2/2000 | Bullock et al. | 347/14 |
| 6,130,695 A | * | 10/2000 | Childers et al. | 347/85 |
| 6,151,039 A | | 11/2000 | Hmelar et al. | 347/7 |
| 6,164,743 A | | 12/2000 | Hmelar et al. | 347/7 |
| 6,168,262 B1 | | 1/2001 | Clark et al. | 347/50 |
| 6,183,077 B1 | * | 2/2001 | Hmelar et al. | 347/86 |
| 6,203,147 B1 | | 3/2001 | Battey et al. | 347/86 |
| 6,227,638 B1 | | 5/2001 | Childers et al. | 347/7 |
| 6,227,643 B1 | | 5/2001 | Purcell et al. | 347/19 |
| 6,416,166 B1 | * | 7/2002 | Robinson et al. | 347/49 |
| D462,089 S | * | 8/2002 | Trafton et al. | D18/56 |

FOREIGN PATENT DOCUMENTS

DE 3405 164 A1 8/1985

OTHER PUBLICATIONS

USSN 29/146,820 filed Aug. 16, 2001, Ink Cartridge, R. Winfield Trafton et al.
USSN 29/146,821 filed Aug. 16, 2001, Ink Cartridge with Integral Handle, R. Winfield Trafton, et al.
USSN 29/146,819 filed Aug. 16, 2001, Ink Cartridge with Ink Color Discrimination Structure, R. Winfield Trafton, et al.
USSN 09/931,523 filed Aug. 16, 2001, Ink Cartridge with Color Discrimination Structure, R. Winfield Trafton, et al.
USSN 09/931,420 filed Aug. 16, 2001, Ink Cartridge with Alignment Features and Method of Inserting Cartridge into a Printer Receptacle, Scott C. Robinson et al.
USSN 09/931,313 filed Aug. 16, 2001, Ink Cartridge with Internal Ink Bag and Method of Filling, R. Winfield Trafton, et al.

* cited by examiner

*Primary Examiner*—Michael Nghiem
(74) *Attorney, Agent, or Firm*—Norman Rushefsky

(57) ABSTRACT

An ink cartridge incorporating a memory chip includes a housing having a top wall, a bottom wall and plural side walls defining the exterior of the cartridge for enclosing a supply of ink. The bottom wall having an aperture formed therein to provide an opening through the exterior surface of the bottom wall. A pocket-like structure is formed within the bottom wall and/or on an inside surface of the bottom wall. A substrate including a memory chip is received in the pocket-like structure, the substrate including at least one electrical contact that faces the aperture so as to be accessible by a contact member external to the cartridge when the cartridge is mounted in a printer's cartridge receiving receptacle.

24 Claims, 12 Drawing Sheets

INK CARTRIDGE WITH MEMORY CHIP AND METHOD OF ASSEMBLING

CROSS-REFERENCE TO RELATED APPLICATIONS

This application is related to the following applications filed on even date herewith in the name of Trafton et al.:

1. U.S. application Ser. No. 09/931,420, now U.S. Pat. No. 6,416,166, and entitled "INK CARTRIDGE WITH ALIGNMENT FEATURES AND METHOD OF INSERTING CARTRIDGE INTO A PRINTER RECEPTACLE";

2. U.S. application Ser. No. 09/931,523 and entitled "INK CARTRIDGE WITH COLOR DISCRIMINATION STRUCTURE"; and 3. U.S. application Ser. No. 09/931,313 and entitled "INK CARTRIDGE WITH INTERNAL INK BAG AND METHOD OF FILLING."

BACKGROUND OF THE INVENTION

The present invention relates to ink jet printing systems that make use of replaceable ink cartridges. More particularly, the present invention relates to a replaceable ink cartridge that includes a memory for storing ink specific information such as, for example, ink type, ink color, remaining ink volume within the ink cartridge.

Ink jet printers frequently make use of an ink jet print head, either thermal or piezoelectric, mounted to a print head carriage The carriage moves back and forth above the print media and generates ink drops as determined by the image in the printer's memory. The ink cartridge can be mounted on the printhead or integral to the print head. Care should be taken in this case when sizing the volume of ink contained on the print head. The inertia of the carriage assembly will increase with an increased volume of ink requiring a more powerful drive motor to overcome its effect during acceleration. The ink cartridge can also be located remote from the carriage with connecting tubes delivering ink to the print heads. The ink tubes generally are flexible and run in a track during the printing operation.

When the ink cartridges are remotely located from the print head and ink is supplied through flexible tubes, the volume of ink contained in the ink cartridge can be large. For example, the Epson 9000 printer uses a 220 ml ink cartridge allowing the operator to print large, complicated images. Typically, these printers will have either four or six black and color ink cartridges each supplying a different print head with ink, This allows for the formation of full color images on sheet or roll media.

When using roll media, the roll is mounted on a feed mechanism, fed across the printer print area and then wound on a take up spool. This process allows the printer to run unattended by the use of a raster image processor (RIP), a local area network (LAN), and a host computer located in a remote location.

The image RIP uses information from the printer regarding the type of ink and media installed on the printer to optimize the image quality of the print. This information can be supplied by the operator or automatically by the printer. Some media rolls include a bar code, which the operator scans into the printer memory when loaded onto the printer. ink cartridges include memory chip assemblies which are programmed; head data stored within the memory, with ink specific information such as ink type, ink color, date of manufacture, date of installation, temperature data if used with a thermal printer, and ink volume remaining.

The memory chip assemblies are typically comprised of a flexible circuit and memory chip. Flexible circuits tend to be more expensive than rigid circuit boards adding to the cost of the product but can be mounted in areas not otherwise accessible. The memory chip can be non-volatile thereby maintaining the ink information without the presence of power. The memory chip assembly is typically mounted on the exterior of the ink cartridge using an adhesive. This process of applying the memory chip assembly to the ink cartridge or print head is dependent on the alignment fixturing used or the ability of the assembler to locate it to the ink cartridge or print head. The number of contacts connecting the memory chip assembly to the printer can be as few as one and as many as necessary to control the information on the memory chip.

The information stored on the memory chip can be used for various reasons such as updating printer parameters each time a new cartridge is installed or for adjusting the printing process based on ink specific information. Some manufacturers write information to the memory chip relating to the number of drops fired from its associated print head thereby estimating the amount of ink remaining in the ink cartridge. For thermal print heads, this information can be used to determine the useful life of the print head.

The present invention relates to a replaceable inkjet ink cartridge that provides ink through a delivery system to print heads on an inkjet printer. The print heads may be of the drop-on-demand type, such as thermal or piezoelectric, or continuous ink jet type. The ink cartridge and ink cartridge receiver assembly includes components that allow for the storage of ink cartridge specific information and access of that information by the printer.

SUMMARY OF THE INVENTION

It is therefore an object of the invention to provide an ink cartridge with an improved memory chip supporting structure and method of assembling the memory chip within the cartridge the novel features of which are set forth in the independent claims appended hereto.

The invention, and its objects and advantages, will become more apparent in the detailed description of the preferred embodiments presented below when read in conjunction with the accompanying drawings.

DETAILED DESCRIPTION OF THE INVENTION

The present description will be directed in particular to elements forming part of, or cooperating more directly with, apparatus and methods in accordance with the present invention. It is to be understood that elements not specifically shown or described may take various forms well known to those skilled in the art.

Figure 1A:
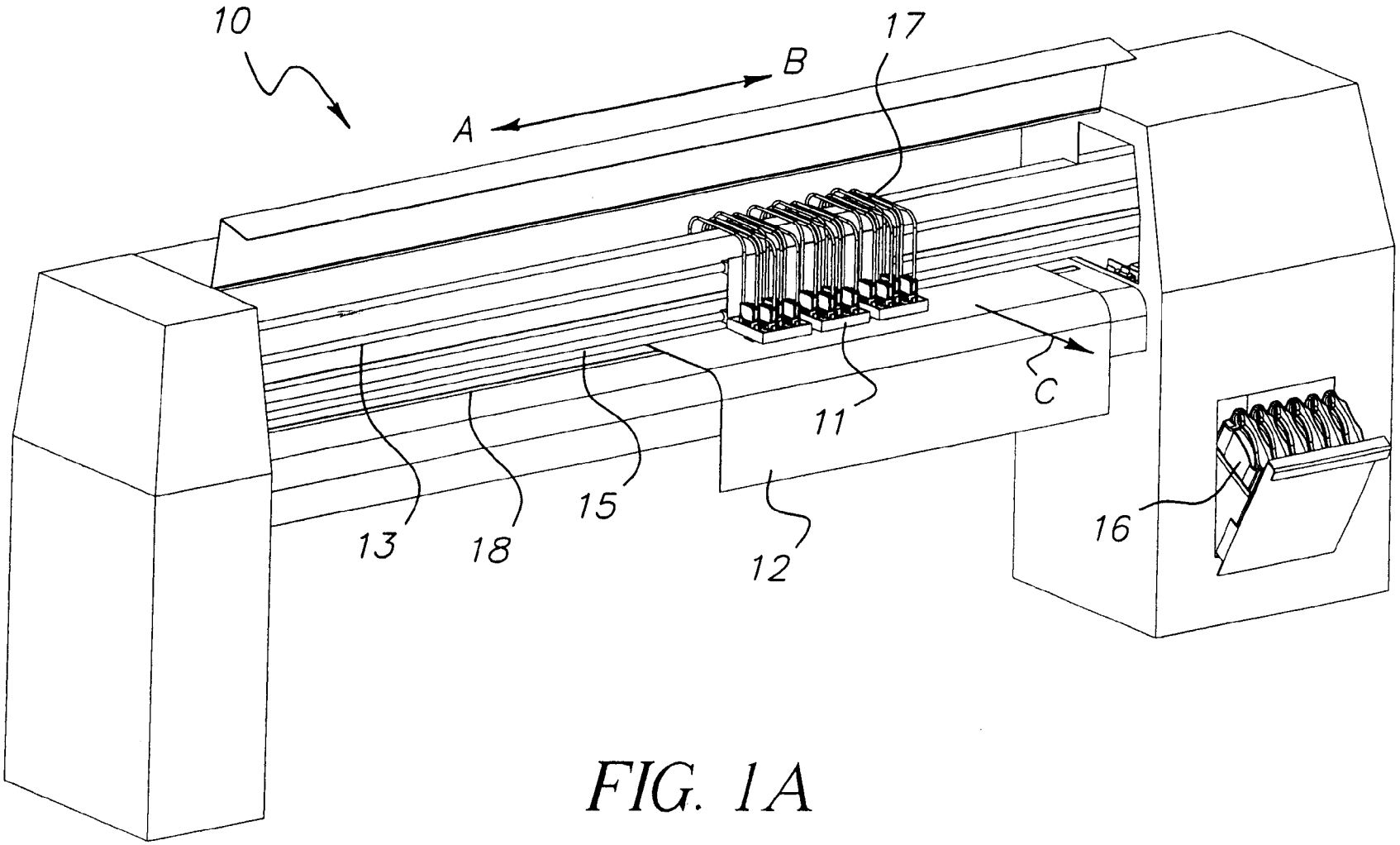
FIG. 1A is a perspective view that illustrates an inkjet printer including a print carriage, carriage guide members, timing belt, ink supply tubing, ink cartridges being in accordance with the invention, a recording element, and sheet transport roller.
Figure 1C:
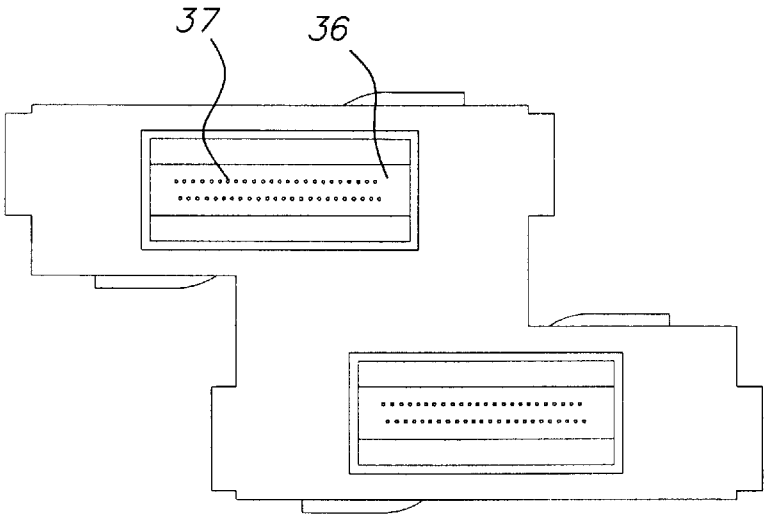
FIG. 1C is a plan view illustrating the nozzle plate for the printhead of FIG. 1B.
Figure 1B:
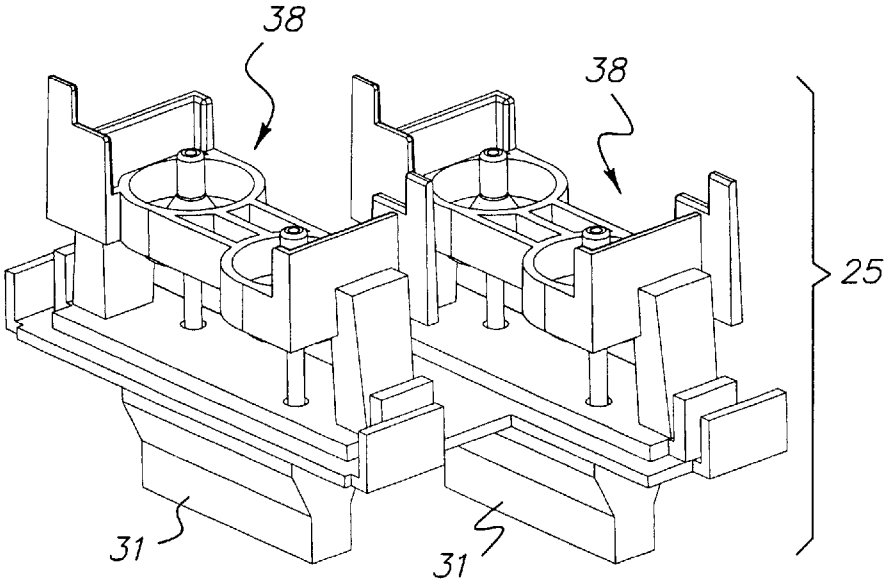
FIG. 1B is a perspective view showing a single color inkjet printhead used in the multicolor printer of FIG. 1A.
Figure 4:
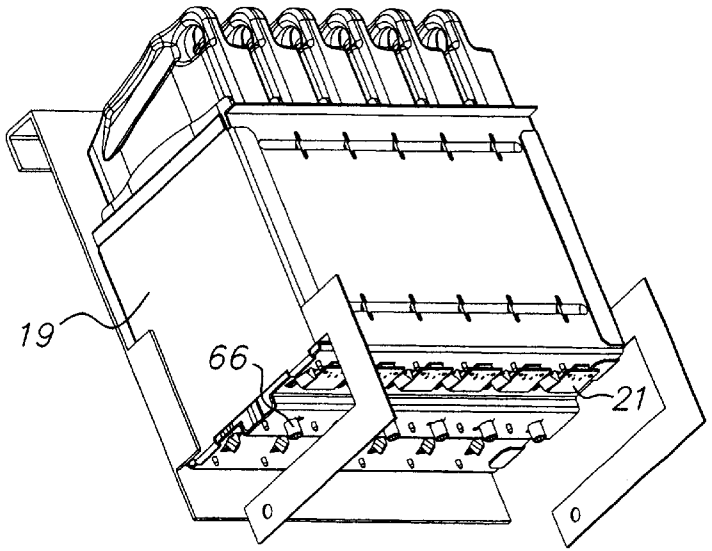
FIG. 4 is a different perspective view of the ink cartridge receiver assembly used in the printer of FIG. 1.

FIGS. 1A–C shows an embodiment of a printer 10 that is adapted to accept a plurality of the ink cartridges of the invention as a main ink supply.

The printer includes a carriage 11 that supports an ink jet print head for movement during printing. The ink jet print head is mounted on a print head module 25 (FIG. 1B) which in turn is mounted to the carriage 11. The carriage 11, is coupled through a timing belt 13 with a drive motor (not shown), is reproducibly movable along the width of a recording medium 12 (in the directions of arrows A and B in the FIG. 1A), while being guided by a guide member 15. The ink jet print head 31 receives ink from the ink tank or cartridge 16 through an ink supply tube 17. An intermediate supply of ink may be provided between the ink cartridge and print head, and thus the ink cartridge may be considered a bulk supply of the ink of a particular color for the printer. A sheet transport roller 18, when driven by a drive motor (not shown), transports the recording medium 12 in the direction (of arrow C in the FIG. 1A) perpendicular to the moving direction of the carriage 11.

A Raster Image Processor controls image manipulation and the resultant image file is delivered to the printer via a remotely located computer through a communications port. On board memory stores the image file while the printer is in operation.

FIGS. 1B and 1C show an embodiment of a piezoelectric print head module or assembly 25. However, the ink cartridge of the invention may be used with other drop-on-demand print heads such as thermal inkjet print heads and continuous inkjet print heads. Reference numeral 36 designates a nozzle plate having nozzle openings 37 formed therein. Numeral 38 indicates an ink supply port through which ink flows from the ink cartridges 16 via the ink supply tube 17. The firing rate of the print head 31 can be switched between 7.5 kHz and 15 kHz depending on the selection of image resolution and print quality. The carriage velocity is fixed in all print modes.

With reference to FIGS. 2–6, there is shown a printer main ink supply 19 that includes a plurality of different color ink containing ink cartridges 16 and ink cartridge receiver assembly 20 that includes individual cartridge receiving receptacles for receiving each cartridge. Six ink cartridges 16 are positioned in the assembly housing of the ink cartridge receiver assembly such that they are each separated by a divider wall or spacer wall 23 that forms a part of the receiver assembly. The ink cartridge 16 is comprised of a housing 50 with a non-symmetrical curvaceous profile 51, integrated hand hold features or handle 53, cartridge alignment features 52, ink cartridge color identifier or color or ink type discrimination structure 60, and a memory chip assembly 55. An ink bag 70 is also supported within the cartridge and contains ink of a particular color. Typically, the ink color used may be cyan, magenta, yellow and black. Different shades of one or more of these colors may also be provided. Thus, for example, there may be provided cartridges with different shades of cyan. A spot color may also be provided, thus providing an option for use of a very particular color.

The cartridge housing includes an ink receiving cavity, and the housing is defined by a front side wall 90, a back side wall 91 opposite the front side wall, a left side wall 94 and a right side wall 93, the left side wall and the right side wall each respectively establishing a spacing between the front side wall and the back side wall. A bottom wall 95 is also provided from which ink is removed from the ink cartridge. The front side wall and the back side wall are curved so that an outer surface of one has a generally convex curvature and the outer surface of the other has a concave curvature. A plurality of alignment recesses or features 52 are formed on the surfaces of the cartridge housing. A first alignment recess 52 is formed on the outer surface of the front side wall and a pair of alignment recesses 52 are formed on the outer surface of the back side wall. The three alignment recesses are formed adjacent to the bottom wall and the first alignment recess is located substantially midway between the pair of alignment recesses in the width-wise direction of the ink receiving cavity. It will be noted from the figures that the recesses 52 are each relatively elongated in the direction of the height of the cartridge and this is advantageous since the cartridge is inserted with the bottom of the cartridge moving towards the bottom of the ink cartridge receiving receptacle.

Therefore, the elongation of the recesses are in the direction of insertion of the cartridges into a respective receptacle. The walls of the ink cartridge are relatively rigid to provide a rigid cartridge structure.

Figure 6:
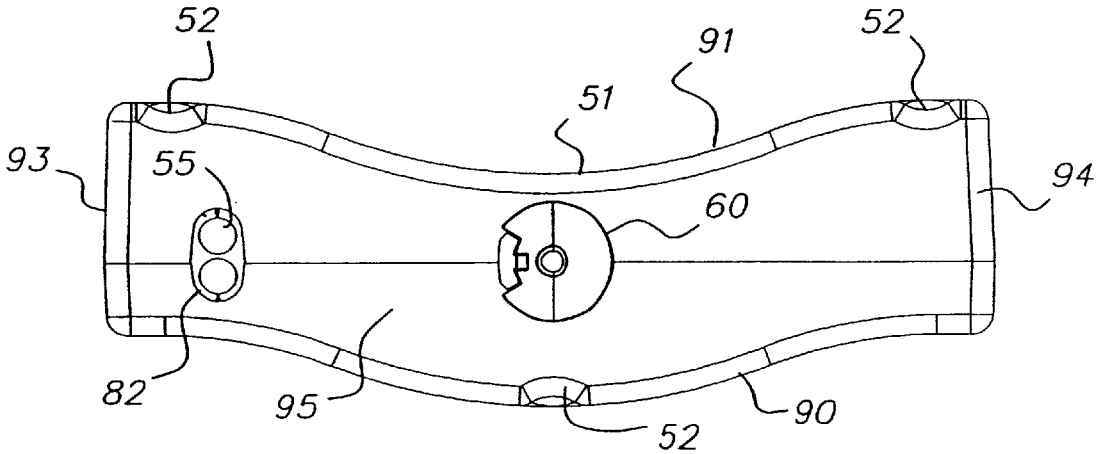
FIG. 6 shows a bottom view of the ink cartridge including the alignment features, memory chip assembly, color identifier, and curvaceous shape.
Figure 7:
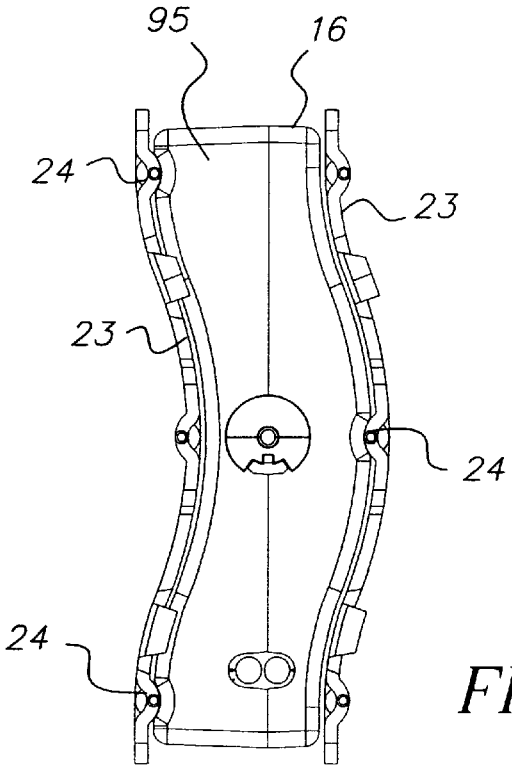
FIGS. 7 and 8 show ink cartridge alignment features engaging with the separators in the ink cartridge receiver assembly.
Figure 8:
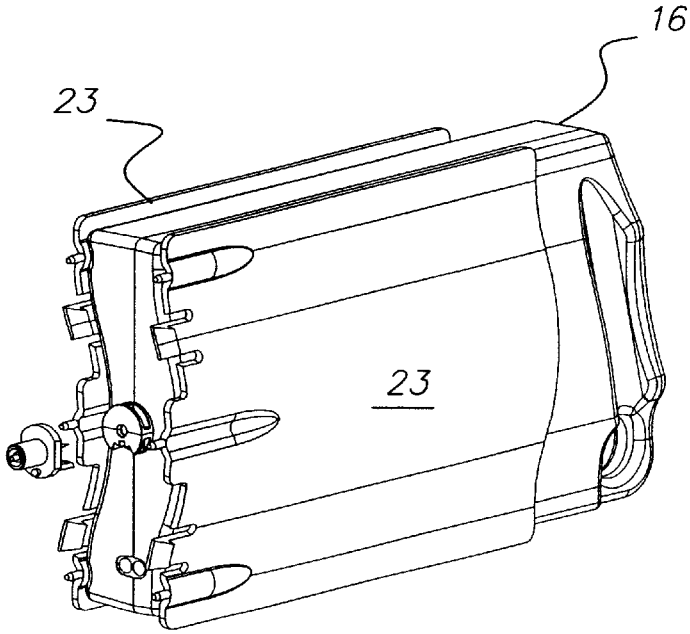

A plurality of identical spacer walls spaced equally from each other in the assembly housing also have cartridge alignment structures 24 thereon (see also FIGS. 6 and 7). Each spacer wall 23 has a curvature to receive a cartridge having a generally complementary curvature to the curvature of the spacer wall. Adjacent spacer walls 23 define a cartridge receiving receptacle and have facing surfaces wherein the location of alignment structures 24 are not identical since the alignment recesses on the front and back surfaces of the cartridge are not identical.

The curvaceous profile 51 of the cartridge 16 is comprised of various radii and appears in a wave shape. This shape can be other non-rectangular shapes such that when nested with other cartridges the orientation of insertion is unidirectional. The provision of a curved shape to the ink cartridge provides a visual aid in describing the proper orientation of the ink cartridge before insertion. The general shape of the cartridge and that of the cartridge receiving receptacle forming a part of the cartridge receiver assembly prevents the cartridge from being inserted incorrectly. This permits electrical contacts forming a part of the memory chip assembly to be aligned with electrical contact members 21 (FIG. 4) in the receptacles of the cartridge receiver assembly 20. The curvaceous profile 51 also stabilizes the ink cartridge when in storage by providing nesting action as cartridges are stacked one on top of the other.

Figure 3:
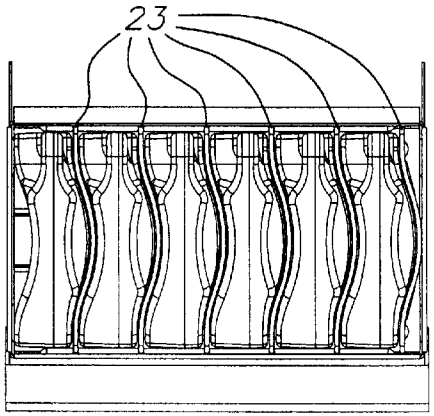
FIG. 3 is a top plan view of the ink cartridge receiver assembly including six ink cartridges, the ink cartridges being in accordance with the invention.
Figure 2:
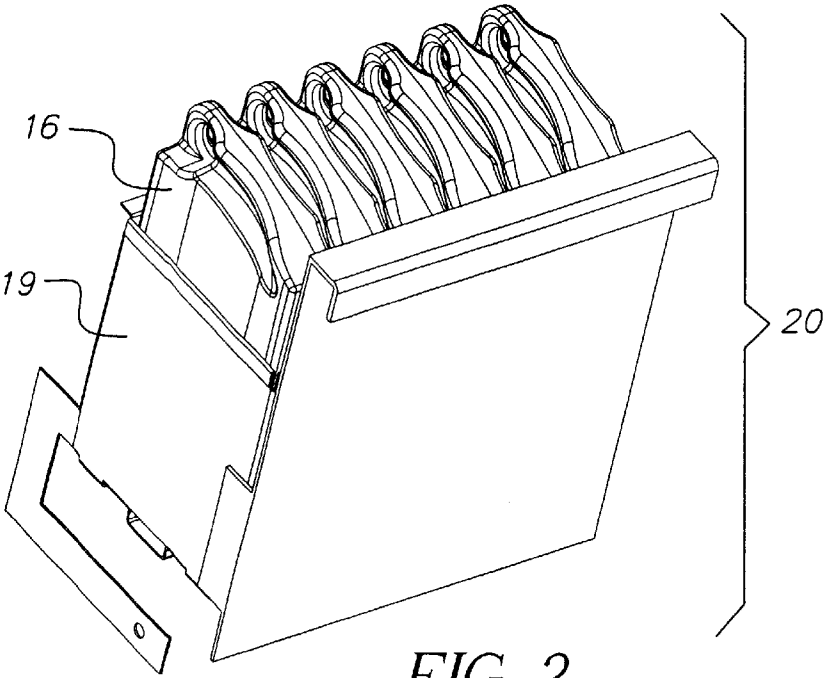
FIG. 2 is a perspective view of an ink cartridge receiver assembly used in the printer of FIG. 1.
Figure 5:
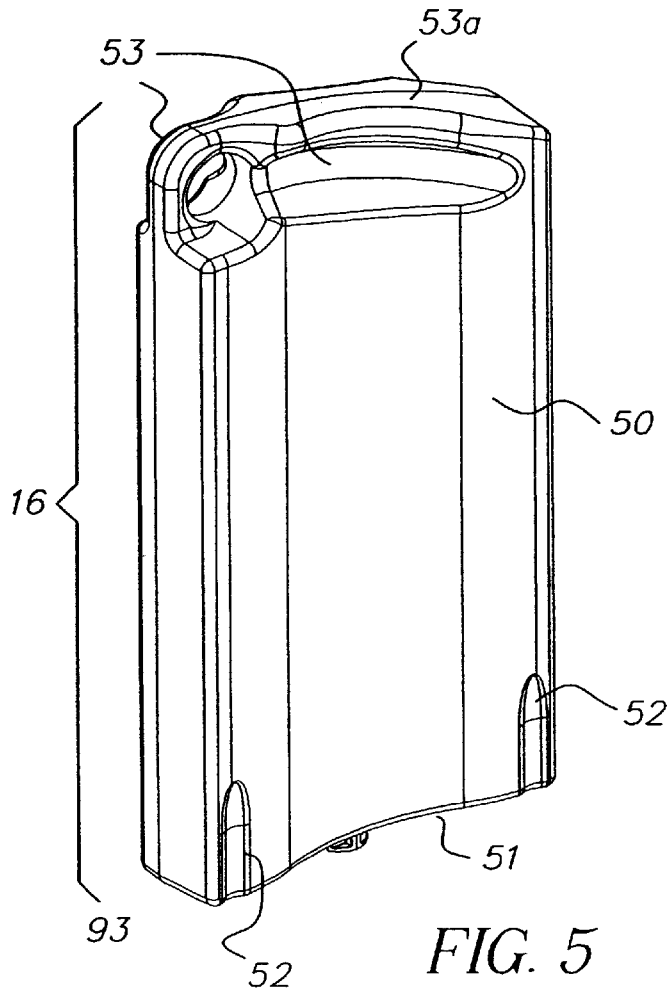
FIG. 5 is a perspective view of the ink cartridge of the invention.
Figure 11:
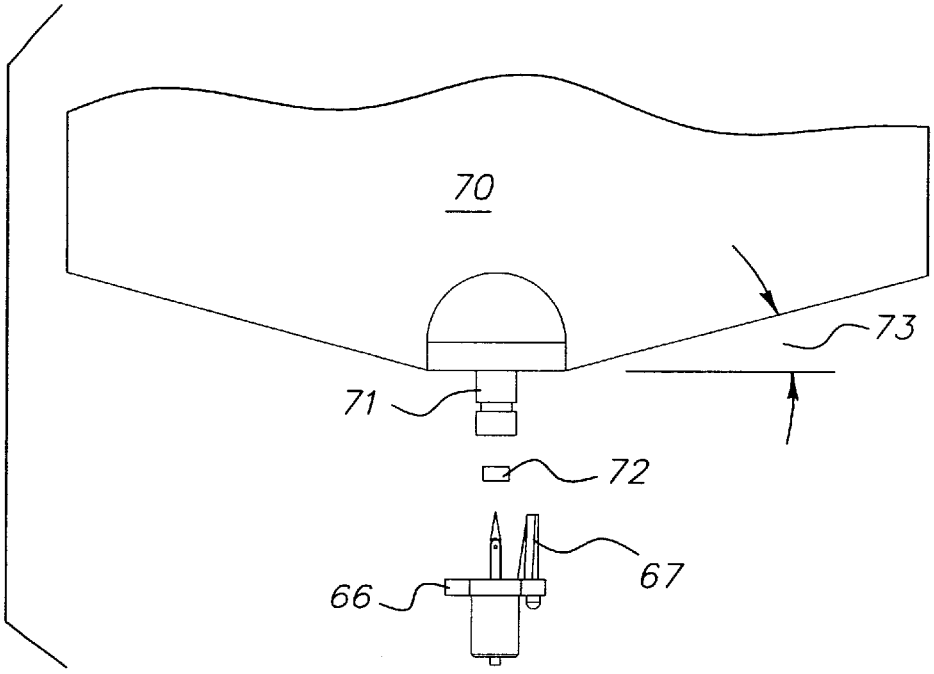
FIG. 11 is an exploded view showing the ink bag, fitment and the septum and ink withdrawal needle which needle forms part of a receptacle in the cartridge receiver assembly.

The ink cartridge housing (FIGS. 5, 6) includes integral alignment features 52 that are molded into the plastic cartridge that mate or cooperate with location structures or features formed in the receptacles of the ink cartridge receiver assembly 19 (FIG. 3). The opening of each receptacle is significantly larger than the ink cartridge allowing for easy insertion. The ink cartridge's alignment features 52 engage with mating location features 24 on the divider or spacer walls 23 (FIG. 7) as the ink cartridge 16 is being inserted into the proper receptacle of the ink cartridge receiver assembly 19. Engagement of these features occurs before the receptacle's ink color identifier key and needle approach the cartridge fitment 71 and septum 72 (FIG. 11). These features align the ink cartridge 16 such that the hollow needle 74 aligns with and pierces the septum 72. The cartridge alignment features 52 also align the ink cartridge such that the electrical contact members 21 (FIG. 4) of each cartridge receiving receptacle are positioned to engage the counterpart electrical contacts 58 of memory chip assembly 55 (FIGS. 13A and 13B) on the ink cartridge 16. It is important to note that the divider walls 23, the ink cartridge housing 50 (FIG. 5) and color identifier (color or ink type discrimination structure) 60 are the same parts used repeatedly in the ink cartridge assembly 20. The difference from one color cartridge to the next is the orientation difference of the color identifier 60 in concert with the orientation difference of the color identifier key tab 67 (see FIGS. 9A and 9B) from one cartridge receiving receptacle to another cartridge receiving receptacle. This design therefore minimizes the manufacturing cost of the ink cartridge assembly 20 by using a minimum number of unique components.

Figure 12:
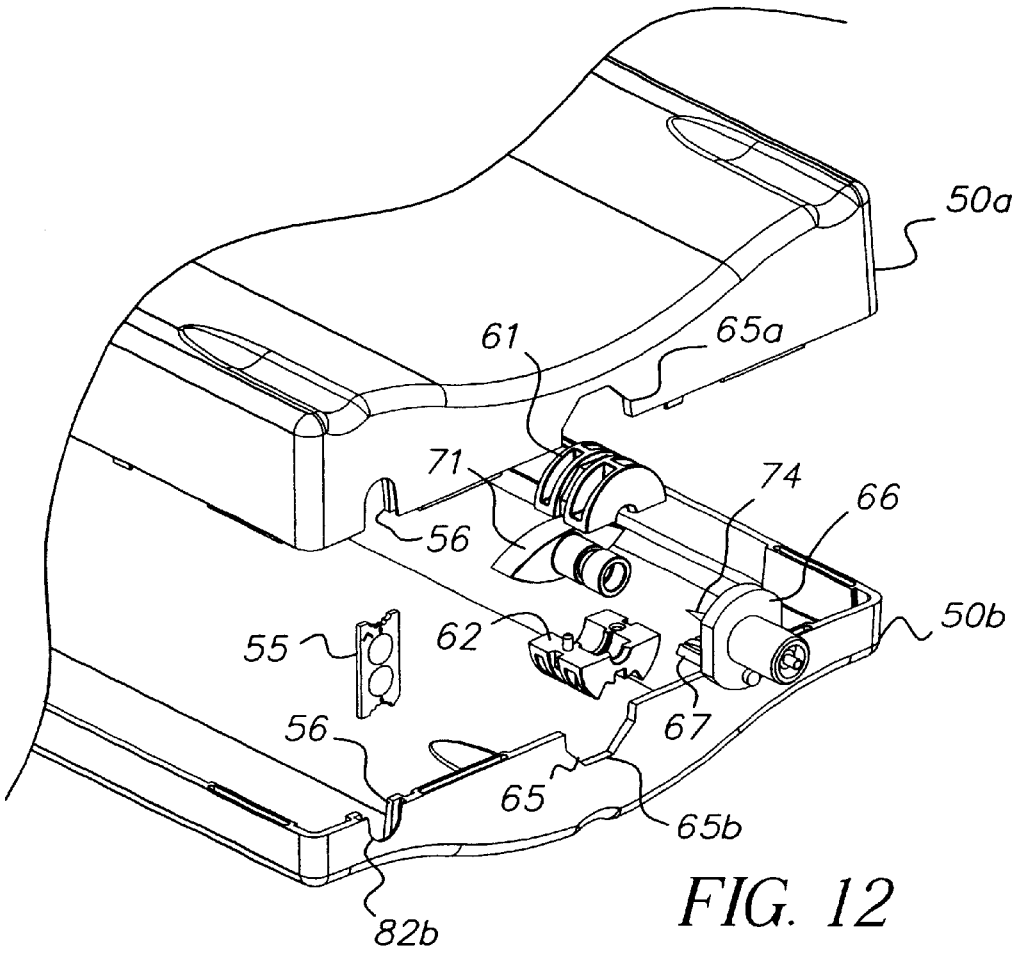
FIG. 12 is an exploded view of the ink cartridge of the invention.

FIG. 12 shows an exploded view of the ink cartridge 16 along with the color identifier key assembly 66. The color identifier 60 is composed of two plastic molded components 61 and 62. During assembly of the cartridge with the ink bag therein, the ink bag fitment extends from the cartridge bottom housing.

Figure 16:
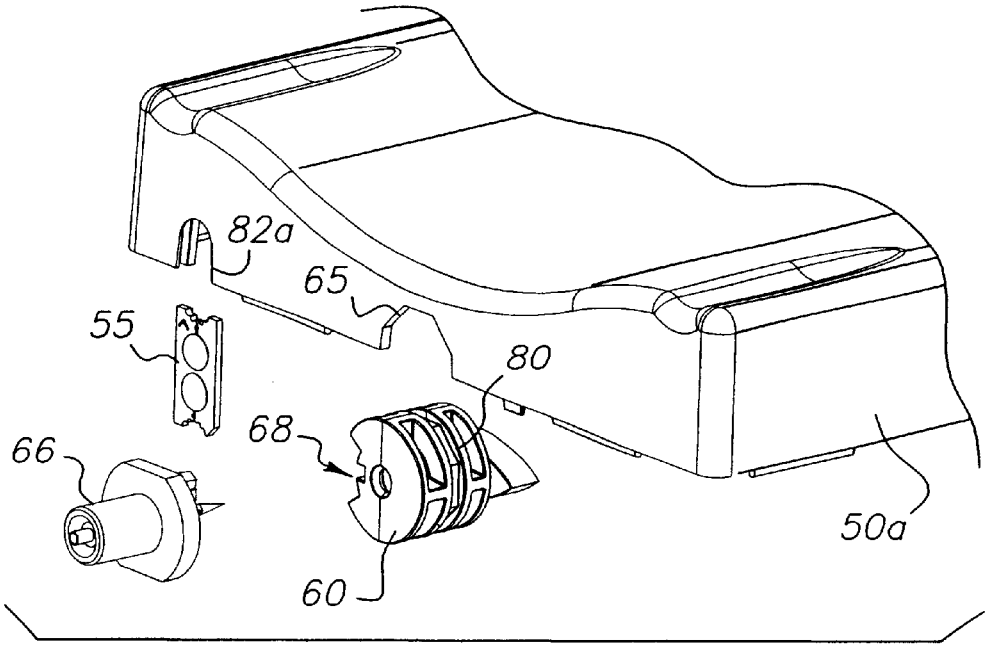
FIG. 16 is an exploded view illustrating further details of assembly wherein the color identifier traps the fitment and forms a collar thereabout.
Figure 17:
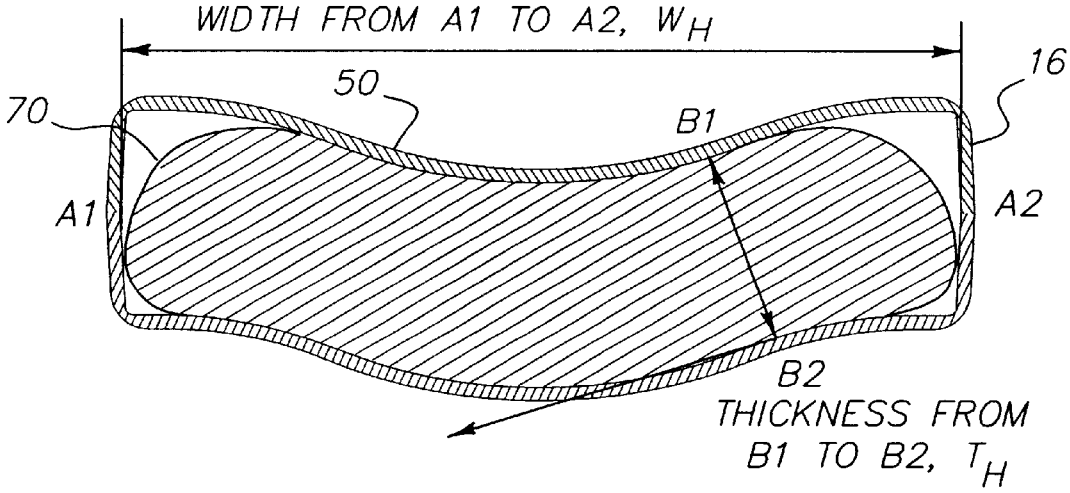
FIG. 17 is a schematic of a cross-section of the ink cartridge illustrating support by the internal surfaces of the ink cartridge of the filled ink bag.
Figure 18:
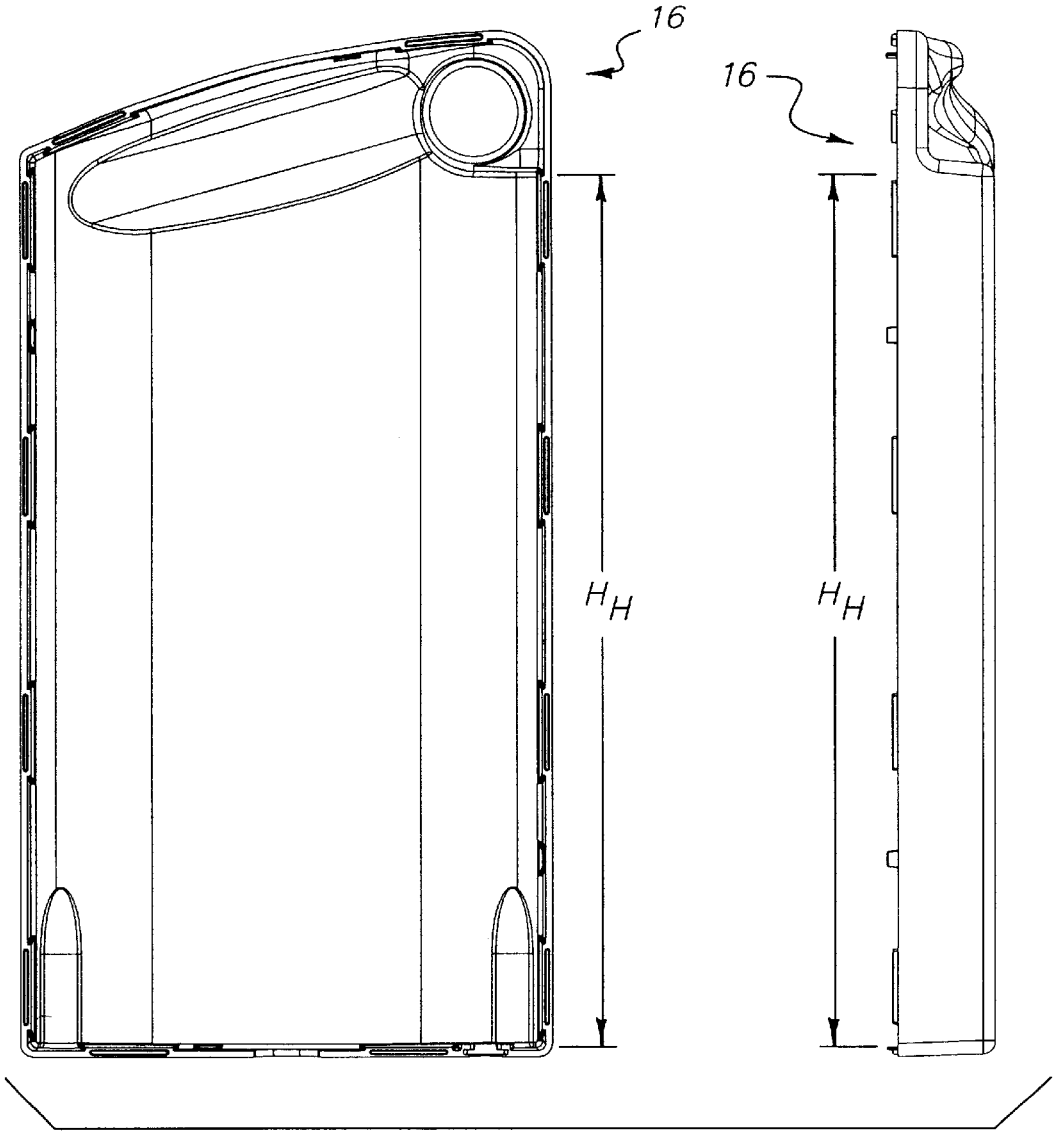
FIG. 18 is a schematic of a front and right side view of the ink cartridge of the invention and illustrating an internal height dimension.
Figure 20:
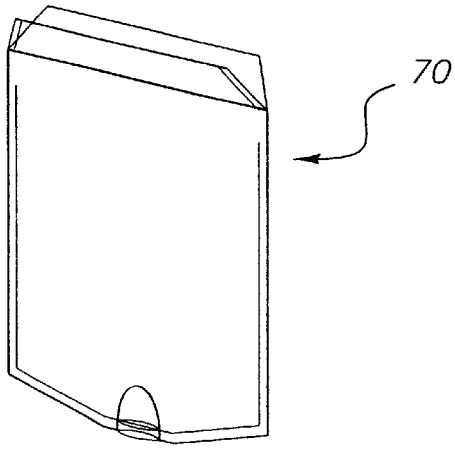
FIG. 20 is a perspective view of the ink bag.
Figure 19A:
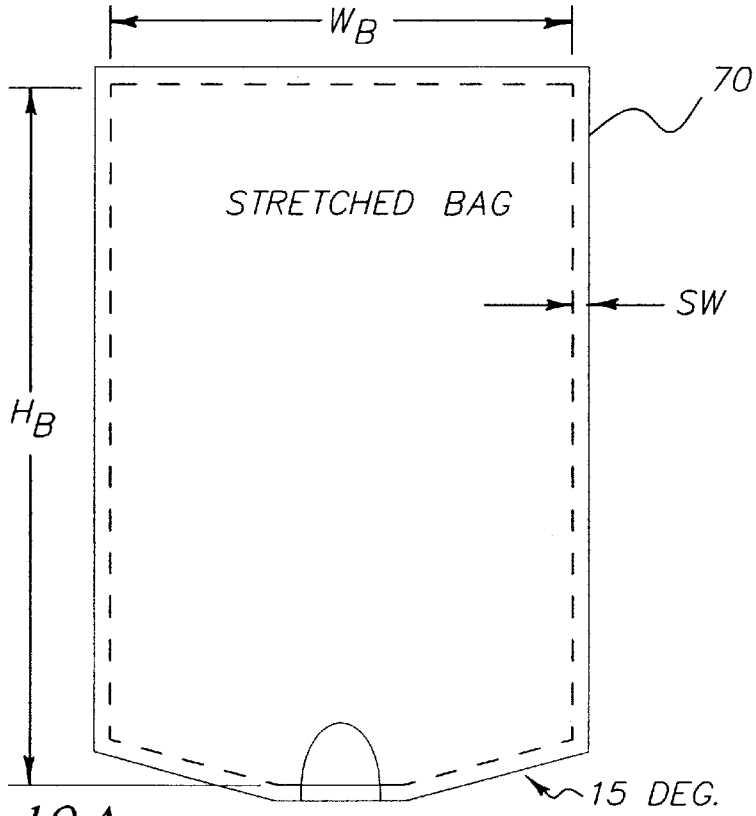
FIG. 19A and FIG. 19B are front side elevational views of the ink bag that is to be positioned in the cartridge and showing respectively the ink bag in a fully stretched condition and the ink bag when it is not stretched.
Figure 19B:
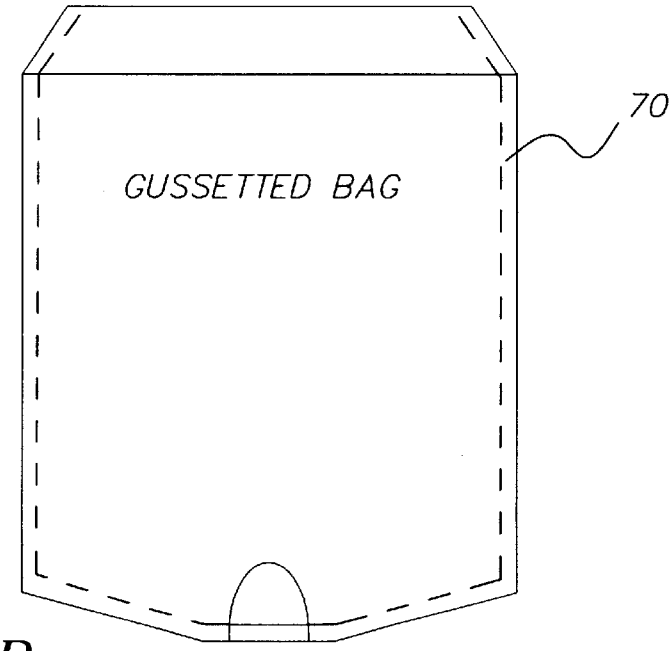

During this assembly, the ink bag fitment 71 is trapped within the color identifier components 61 and 62 which are mated together and which form a collar thereabout, and thereby secure the fitment for presentation to the needle 74 during ink cartridge insertion into the receiver assembly 20. Referring to FIG. 16, an octagon shaped member 80 on and molded integral with the color identifier 60 mates with an octagonal recess 65 molded in the wall of the bottom surface of the ink cartridge housing 50. It will be understood that the ink cartridge housing 50 is formed of housing halves 50*a* and 50*b* that are ultrasonically welded together to assemble the cartridge with the various parts such as the ink color identifier 60 and memory chip assembly 55 secured thereto. Each housing half includes a recess 65*a*, 65*b* that defines four surfaces of the eight surfaces of the octagonal recess 65. The color identifier 60 can be oriented in eight unique angular positions each being specific to one of eight different ink colors prior to assembly of the cartridge housing halves. Although eight unique positions are illustrated for this particular ink cartridge this is but an example, and generally speaking the color identifier may be oriented in plural positions to provide for color or ink type discrimination for plural different ink containing cartridges. Although there is shown that an octagonal member rests within a recess formed in the cartridge housing, other positioning structures can be used for positioning purposes to allow support for a member to be changed in orientation so that the same parts can be used for different color ink cartridges. In this example, the color identifier is a generally cylindrical member and can be rotated about the central axis thereof prior to assembly of the cartridge housing halves and placed in the octagonal recess in a manner appropriate for the color of the ink to be placed in the cartridge. In this regard it should be noted that while discussion hereinabove has been in relation to cartridges containing different colors of ink or shades thereof, the invention contemplates that cartridges containing different types of ink may also be placed in the receptacles, such as one cartridge may contain ink formed from pigments and another contain ink formed from dyes. Alternatively, different cartridges may contain ink of different densities. Thus, the color identifier 60 can be broadly referred to as a color or ink type discrimination structure.

Figure 9A:
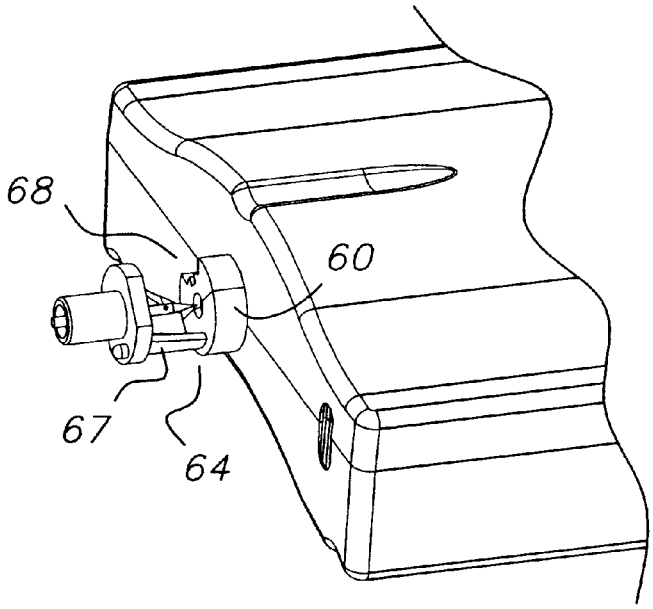
FIGS. 9A and 9B show how the color identifier keyway and color identifier key tab interface when the ink cartridge is placed in the receiver assembly the FIGS. showing respectively and incorrect cartridge being attempted to be placed in the receptacle and a proper ink cartridge being placed in the receptacle.
Figure 9B:
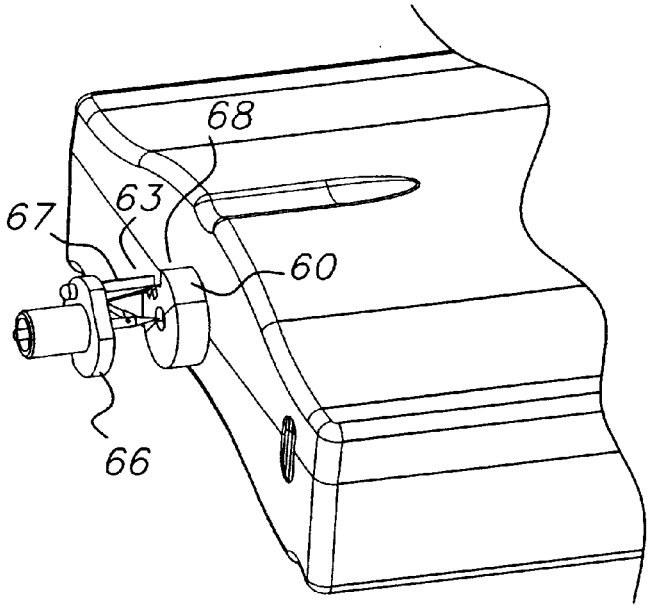
Figure 10:
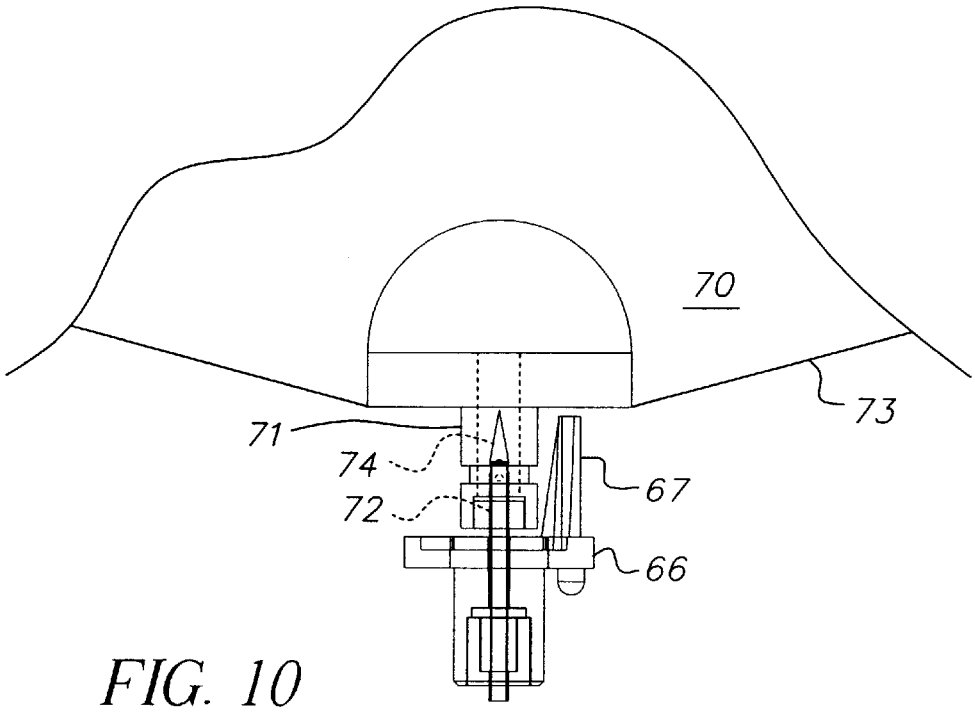
FIG. 10 shows receipt of an ink withdrawal needle from the receptacle being engaged with an ink bag that is internal to the ink cartridge.

Referring to FIGS. 12 and 16, the color identifier 60 is positioned in the octagonal recess 65 of the ink cartridge housing halves 50*a*, 50*b* in a unique orientation for each color or ink type to be placed in the ink cartridge 16 and assembled. The color identifier key tab 67 is located at the bottom of the ink cartridge receiver assembly and is oriented such that only one color of ink in a specific ink cartridge can be fully inserted. If the color identifier key tab 67 is aligned with the key slot or keyway 68 in the color identifier 60 as shown by configuration 63 (see FIG. 9B), then full engagement of the needle 74 with the septum 72 will be accomplished (FIG. 10). If the ink cartridge 16 is installed in a cartridge receiving receptacle configured for another ink color, then the orientation of the color identifier key tab 67 will not line up with the keyway 68 in the color identifier 60 as shown by configuration 64 (FIG. 9A). Engagement of the needle 74 with the septum 72 will be prevented and therefore cross contamination of two different colors of ink will be avoided. These color identifier features do not align the cartridge to the cartridge receiving receptacle but only prevent full insertion of the ink cartridge in the cartridge receiving receptacle if the cartridge is filled with a color of ink not intended for that receptacle. This color identification method allows for the same parts to be used for every color cartridge with only a unique orientation change made during the cartridge assembly process. Therefore, the number of manufacturing tools and number of unique parts required in inventory to produce cartridges adapted to contain ink of various colors is minimized and costs to produce them reduced. A seal may be provided over the septum and color identifier 60 after assembly of the cartridge parts.

With reference to FIGS. 12–16, a non-volatile memory chip assembly 55, constructed using a rigid circuit board 57, non-volatile memory chip 59 and gold contacts 58, is located within a pocket 56 integrally molded on the ink cartridge housing. The pocket 56 includes integral locating features for receiving the memory to assembly. The pocket including these integral features are molded as part of the ink cartridge housing and retain the memory chip assembly 55 once the housing is assembled. Each cartridge housing half includes structure for defining the pocket 56. The location of the memory chip assembly relative to the ink cartridge housing is controlled strictly by the integral features and therefore does not require any manual or automated alignment fixturing for assembly purposes. The memory chip assembly is simply placed in the pocket portion formed in each cartridge housing half and as the housing halves are brought together and then welded together the integral features defining the pocket structure self locate the memory chip assembly within the pocket. In order to insure the data and neutral lines coming from the printer are in communication with their respective data and neutral input pins on the memory chip, a chamfer is added to one corner of an edge of the rigid circuit board 57. A mating filled in area 76 is formed as part of the integral locating features that define the pocket on the cartridge housing. As shown in the drawings and particularly in FIG. 14, each cartridge housing half includes a slot formed in the bottom wall of the cartridge and/or on the inside wall of the cartridge to define the pocket structure 56 about an aperture 82 formed in the bottom wall of the cartridge. The aperture actually has aperture parts 82a and 82b formed in respective housing halves 50*a* and 50*b*. The housing halves of the cartridge cannot come together during assembly of the cartridge unless the chamfer 75 on the circuit board is properly located in the pocket structure and particularly in the pocket portion having the mating filled in area 76 which is generally complementary in shape to the chamfer 75. This insures proper orientation of the memory chip assembly during the assembly process. The location tolerance of the gold contacts relative to the electrical contacts on the ink cartridge receiver assembly, once retained by the housing, is dependent on the capability of the injection molding process. Other contributing tolerances include the size of the rigid circuit board, the location tolerance of the gold contacts on the rigid circuit board, and the location tolerances of the components within the ink cartridge receiver assembly including the location tolerance associated with the electrical contacts. With reference to FIGS. 13A and 13B, the size of the gold electrically conductive electrical contacts 58 has been increased to a point allowing for economical tolerances to be applied to all the associated components relating to the alignment of the memory chip gold contacts to the electrical contacts. In the preferred embodiment, the area of each of the two circular electrical contacts 58 is equivalent to a circle having a diameter of about ¼ of an inch (6.3 millimeters). While a circular area is shown for each electrical contact 58, other relatively large electrically conductive areas of different configuration may be used. The memory chip 59 may be of the type sold by Dallas Semiconductor Corp. of Dallas, Tex., U.S.A. such as, for example, chip DS 2502, and feature one line served by one electrical contact of the circuit board 57 for providing data to and from the printer's computer controller. The second line and served by the second electrical contact of the circuit board 57 may be for a ground reference connection. Traces leading from the memory chip connect with throughways or vias 54 that pass through the circuit board and connect with the electrical contacts 58 formed on the other side of the circuit board. As noted in the FIGS. 13A and 13B, the ends of the circuit boards may have "mouse bites" which are common in the manufacture of small circuit boards.

Figure 13A:
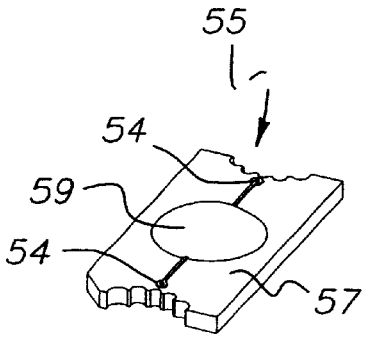
FIGS. 13A and 13B is a perspective view illustrating details of the memory chip assembly.
Figure 13B:
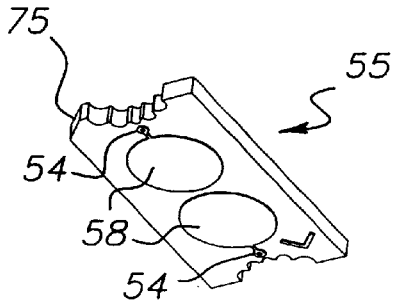
Figure 14:
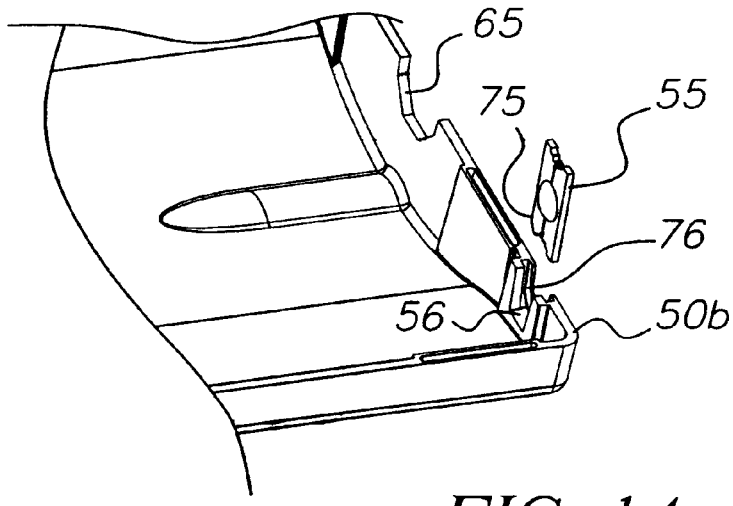
FIG. 14 is a perspective view of an ink cartridge housing half and a memory chip assembly being mounted in the housing half.
Figure 15:
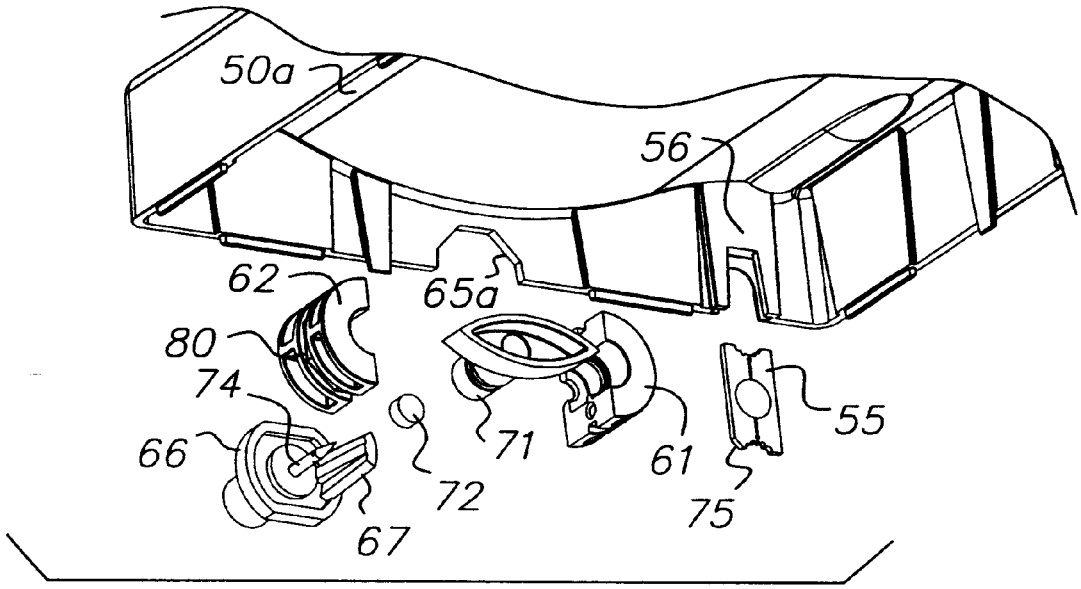
FIG. 15 is an exploded view illustrating the details of assembly and shows the details of the ink bag fitment, septum, color identifier, memory chip assembly, ink cartridge housing half and the ink withdrawal needle which forms part of the receptacle, the view being taken from the underside of the cartridge half.

Thus, there has been described a memory chip assembly 55 that is received within a pocket structure 56 formed in the cartridge bottom that includes integral mating features as part of the ink cartridge housing 50. The memory chip assembly 55 consists of a circuit board 57, a memory chip 59, and electrical contacts 58 (FIGS. 13A and 13B). The circuit board is rigid and inserted into the pocket structure 56. The integral features of the pocket structure are molded as part of the ink cartridge housing and retain the memory chip assembly once the housing is assembled with the electrical contacts 58 facing outwardly through an aperture 82 formed in the bottom side of the cartridge. The location of the memory chip assembly and importantly the respective electrical contacts on the circuit board relative to ink cartridge housing is controlled strictly by the integral features of the pocket structure and therefore does not require any manual or automated alignment fixturing for assembly purposes. In order to insure the data and neutral lines coming from the printer are in communication with their respective data and neutral input pins on the memory chip, a chamfer 75 or other suitable structure for restricting insertion of the circuit board into the pocket in only one-way is added to one corner of the rigid circuit board. A cooperating structure provided in the pocket structure such as the filled in area 76 (FIG. 14) is formed as part of the integral locating feature of the pocket structure on the cartridge housing. This insures proper orientation of the memory chip assembly and particularly the respective electrical contacts thereof during the assembly process.

The location tolerance of the gold contacts relative to the electrical contacts on the ink cartridge receiver assembly, once retained by the housing, is dependent on the capability of the injection molding process. Other contributing tolerances include the size of the rigid circuit board, the location tolerance of the gold contacts on the rigid circuit board 57, and the location tolerances of the components within the ink cartridge receiver assembly 19 including the location tolerance associated with the electrical contacts 54. The size of the gold contacts 58 are substantially increased to a point (a circular area of each is about ¼ of an inch in diameter) allowing for economical tolerances to be applied to all the associated components relating to the alignment of the memory chip gold contacts to the electrical contacts.

With reference to FIGS. 11, 19A and 19B, and 20 illustrate details regarding the construction of the ink bag 70 that is located within the cartridge. The fitment 71 is thermally sealed to the bag material. The flexible ink bag material is composed of three layers with adhesive between each layer. Each layer has a specific purpose by providing either compatibility with the ink, low water vapor and gas permeability, or abrasion resistance. The inside layer, in contact with the ink, is either a linear low density or low density polyethylene. The fitment is made front a high-density polyethylene thereby promoting good adhesion of it to the bag during the thermal welding process. The middle layer is aluminum foil providing low water vapor and gas permeability, and the outer layer is either nylon or polyethylene terepthalate having high strength and abrasion resistance. The septum 72 is inserted into the circular opening of the fitment 71. The inside diameter of the circular opening of the fitment is smaller than the outside diameter of the septum creating a slight compression of the septum once inserted into the fitment. Once assembled, the bag, fitment and septum must allow for an efficient filling and evacuation process. A feature to the function of the ink bag is the taper angle 73 illustrated in FIG. 11.

It is important to minimize the amount of trapped air remaining in the bag once filled with ink. If air remains in the bag, it will dissolve into the ink between the time of manufacture and usage. Dissolved gases in the ink will come out of solution during the firing process of the piezoelectric print head and form air bubbles. Air bubbles, being compressible, will prevent the nozzles from expelling a drop of ink onto the print media 12. The taper angle 73 helps expedite the evacuation of air in the bag during the filling process and allow for a majority of the ink to drain from the bag during usage.

During the filling process, the bag is evacuated of air before ink is injected into it. When the ink bag is full the remaining air, now near the fitment and septum, is evacuated. If the taper angle is not present the air tends to become trapped in the corners of the bag and can not be evacuated. The angle allows the remaining air to move to the fitment and thereby allows for its removal. The taper angle 73, which is formed from the area of the bag near the fitment and tapers to a vertical side edge of the bag should be between 5 and 45 degrees. In the preferred embodiment, a taper angle of 15 degrees is provided.

Referring to FIGS. 17, 18, 19A, 19B, the ink cartridge housing 50 includes a volume $V_H$ within it comprising an volume to contain the ink bag 70. An additional volume is included within the cartridge housing located above $V_H$ that provides space for an integral handle 53 having a top wall 53*a*. The cartridge handle eases transportation by the customer. The volume $V_H$ of the cartridge housing containing the ink bag is defined having a height $H_H$ (see FIG. 18), a width $W_H$ (see FIG. 17), and a thickness $T_H$ (see FIG. 17). The aspect ratio of the thickness $T_H$ to width $W_H$, the cartridge height $H_H$ and the flexible ink bag determine the optimum relationship between the volume of ink in the bag, the remaining ink after use, and residual air remaining in the bag after filling. This relationship is defined as follows:

$T_H$: Thickness of the cartridge housing defined as the distance between the inside surfaces of the front and back side surfaces of the housing assembly.

$W_H$: Width of the cartridge housing defined as the distance between the inside surfaces of the left and right side surfaces of the housing assembly.

$H_H$: Height of the cartridge as defined as the distance from the inside surface of the bottom side of the cartridge housing to the top of the cavity designed to contain the ink bag. This does not include the additional height of the cartridge required to form the integral handle. This inside surface is molded with a draft so the measurement is taken from an edge where the cartridge housing halves are joined.

$V_H$: Interior volume of the housing assembly containing the ink bag.

$W_B$: Overall width of the ink bag when empty, lying flat and stretched to its full extents regardless of the presence of a gusset.

$H_B$: Overall height of the ink bag when empty, lying flat and stretched to its full extent regardless of the presence of a gusset.

SW: Seal width of the bag, representing a seal width running along the sides of the ink bag and thus provides for a smaller inside volume of the bag.

$W_H{:}T_H=4.32{:}1$ (4.32+/−0.10)

$V_H=4.32\ T_H{}^2H^H$

For: 180 mm$<H_H<$500 mm $W_B=T_H\pi/2+W_H-T_H+2SW$ $H_B=H_H+T_H$

The method utilized in the assembly of the ink cartridge is benefited by the design. The advantage of sizing the ink bag and cartridge housing according to the relationships stated above allows for the assembly of the ink bag to the cartridge housing before the ink filling process is initiated. The process of assembly includes evacuating the ink bag of air, laying the first half of the cartridge housing on its side, placing color identification components around the fitment of the ink bag, and inserting the ink bag into the first housing using two sided tape. The insertion of the bag is made such that the empty ink bag is conformed to the profile of the first housing half, taped in place using double-sided tape, and then covered with the second housing half. The first and second housings halves are then ultrasonically welded together. The ultrasonic welding process providing a low cost assembly method although other known methods may be used.

Once the housing assembly is welded, the ink bag is filled with a known amount of ink (for example, 1100 mL) while lying on its side and by placing a needle through the septum and pumping ink through the needle and into the ink bag. The cartridge assembly is then turned vertically such that the fitment and septum are facing up. The cartridge may be bumped to cause air in the ink to rise to the top of the bag. The remaining air and about 50 mL of ink are then removed from the bag by applying a vacuum through the needle. At this point the ink bag is fully constrained by the housing and the surface of bag is in intimate contact with the four inside surfaces of the housing assembly as illustrated in the horizontal sectional view shown in FIG. 17. This prevents the bag from shifting during transport. If shifting were to occur then the bag surface could potentially abrade and rupture resulting in ink leakage. If the ink bag was filled prior to the ultrasonic welding process it may also become abraded from the welding process and subsequently rupture. The method of assembly and the configuration of the housing in concert with the ink bag together result in a low cost ink cartridge assembly. As may be noted from FIG. 17 at the section shown there is a uniform internal cartridge cavity thickness spacing between corresponding points on the respective internal surfaces of the front and back side walls even though the front and back sides are curved as are their internal surfaces. The front and backsides are curved complementary; for example one is generally concave in curvature and the other is generally convex in curvature, but internally they maintain a generally uniform spacing between corresponding points on the internal surfaces at least along a certain section through the cartridge.

The memory chip is located at the bottom side of the ink cartridge housing to allow for a simple, low cost electrical contact design for engaging the electrical contact members in the ink cartridge receiver assembly. While other places on the ink cartridge housing could be used to support the memory chip assembly 55 it is desirable that the memory chip assembly be positioned so as to avoid close proximity to the ink bag 70. When located at the bottom side or wall 95 of the ink cartridge housing in the position illustrated in the Figures, taper of the bag's lower edge, though not absolutely necessary, allows for the bag, when filled with ink, to avoid contact with the pocket structure 56 supporting the memory chip assembly. If contact is allowed, then abrasion may result and cause ink to leak from the bag. Thus, the bag 70 when full can rise over the pocket structure within the ink cartridge housing through use of the taper formed on the bag. It is preferred to position the pocket structure 56 relative to the left and right side walls of the cartridge so that the pocket structure is spaced sufficiently therefrom such that cartridge housing wall thickness remains closer to nominal wall thickness and the reliability of the mold tooling for molding these cartridges is better maintained. A further advantage is provided in having the mounting location of the memory chip assembly be beneath the finger hole of the handle. This relationship exists due to the way the ink cartridge receiver assembly 20 tips out for easy access to the ink cartridges. In this regard reference is made to FIGS. 1*a*, 2 and 4. Normally the ink cartridge receiver assembly 20 is positioned in the closed position (not shown) when no access to the ink cartridges is required. When the ink cartridge receiver assembly is tipped or pivoted outwardly as shown to provide operator access to the ink cartridges 16, the memory chip assembly on each cartridge and the electrical contacts 21 in each cartridge receiving receptacle are tipped upwardly. This allows gravity to force any ink that has leaked from an ink cartridge to move away from the memory chip assembly and the electrical contacts as the ink cartridge receiver assembly is pivoted to the open position. In order to optimize position of the electrical contacts 58 of the memory chip assembly with the various considerations expressed above the structure for supporting the memory chip assembly is on the bottom wall and desirably about 8 to 9 millimeters from the inside surface of the right side wall 93. This positions the centers of the electrical contacts 58 at about 19 millimeters from the outer surface of the right side wall. The right side wall being the wall of the cartridge housing that would be pivoted upwardly as the cartridge receiver assembly is pivoted to the open position. The width dimension of the cartridge housing; i.e. distance between right side wall and left side wall, limits the distance the memory chip assembly can be located away from the septum. In order to avoid contamination with ink that has leaked, it is preferred that this distance be as great as possible and because of constraints regarding placement close to the side wall an optimum location for a spacing is as noted above about 19 millimeters from the outside surface of the right side wall for the cartridge described. For the cartridge described, the optimum spacing of the centers of the electrical contacts 58 to the center of the septum 72 is about 57 millimeters.

The invention has been described in detail with particular reference to preferred embodiments thereof, but it will be understood that variations and modifications can be effected within the spirit and scope of the invention.

PARTS LIST

10 Printer
11 Carriage
12 Recording Medium
13 Timing Belt
15 Guide Member
16 Ink Tank or Cartridge
17 Ink Supply Tube
18 Sheet Transport Roller
19 Main Ink Supply
20 Ink Cartridge Receiver Assembly
21 Electrical Contacts
23 Divider or spacer walls
24 Location Structures
25 Print Head Module or Assembly
31 Ink Jet Print Head
36 Nozzle Plate
37 Nozzle Openings
38 Ink Supply Port
50 Ink Cartridge Housing
50*a*, 50*b* Cartridge Housing Halves
51 Curvaceous Profile of Cartridge Housing
52 Alignment Features or Recesses
53 Handle
54 Electrical Throughways
55 Memory Chip Assembly
56 Pocket Structure
57 Circuit Board
58 Electrical Contacts
59 Memory Chip
60 Ink Cartridge Color Identifier or Color or Ink Type Discrimination Structure
63 Configuration
64 Configuration
65 Octagonal Recess
65*a*, 65*b* Octagonal Recess Halves
66 Color Identifier Key Assembly
67 Ink Color Identifier Key Tab
68 Key Slot or Keyway
70 Ink Bag
71 Fitment
72 Septum
73 Taper Angle
74 Needle
75 Chamfer
76 Filled in Area of Pocket Structure
80 Octagonal Shaped Member
82 Aperture for Access to Memory Chip Contacts
82*a*, 82*b* Aperture Halves
90 Front Side Wall
91 Back side Wall
93 Right Side Wall
94 Left Side Wall
95 Bottom Wall

What is claimed is:

1. An ink cartridge incorporating a memory chip, the cartridge comprising:

an ink cartridge housing having a top wall, a bottom wall and plural side walls defining the exterior of the cartridge for enclosing a supply of ink;

the bottom wall having an aperture formed therein to provide an opening through the exterior surface of the bottom wall;

a pocket-like structure formed within the bottom wall and/or on an inside surface of the bottom wall, the pocket-like structure being formed about the aperture; and a substrate including the memory chip received in the pocket-like structure, the substrate including at least one electrical contact that includes an electrical contact surface that faces the aperture so as to be facing outwardly of the cartridge and being accessible to a contact member external to the cartridge when the cartridge is mounted in a printer's cartridge receiving receptacle and wherein the substrate comprises a relatively rigid circuit board and the pocket-like structure includes walls which locate the circuit board in the cartridge and further wherein the cartridge housing is formed by mating two housing halves, each housing half including part of the top wall, part of the bottom wall, a complete side wall and part of two other side walls of the plural side walls, and each housing half further including in and/or on an internal surface of the respective bottom wall part of the pocket-like structure so that when the two housing halves forming the cartridge housing are imitated the circuit board is trapped within the pocket-like structure formed by the two housing halves and further wherein a chamfer is formed along an edge of the circuit board and the pocket-like structure includes an edge receiving surface with a complementary shape for receiving the edge with the chamfer for proper seating in. the pocket-like structure and wherein the edge receiving surface is configured to block proper seating of the circuit board within the pocket-like structure when a different edge of the circuit board is attempted to be inserted into the cartridge so that the two housing halves are blocked from being mated when the circuit board is incorrectly received in the pocket-like structure.

2. An ink cartridge incorporating a memory chip, the cartridge comprising:

an ink cartridge housing having walls defining the exterior of the cartridge for enclosing a supply of ink;

one of the walls having an aperture formed therein to provide an opening through or within said one wall;

a pocket-like structure formed in said one wall and/or on an inside surface of said one wall, the pocket-like structure being formed about the aperture; and a substrate including a memory chip received in the pocket-like structure, the substrate including at least one electrical contact including an electrical contact surface that faces the aperture so as to be facing outwardly of the cartridge and being accessible to a contact member external to the cartridge when the cartridge is mounted in a printer's cartridge receiving receptacle and wherein a chamfer is formed along an edge of the substrate and the pocket-like structure includes an edge receiving surface with a complementary shape for receiving the edge with the chamfer for proper seating in the pocket-like structure and wherein the edge receiving surface is configured to block proper seating of the substrate within the pocket-like structure when a different edge of the substrate is attempted to be inserted into the cartridge.

3. An ink cartridge incorporating a memory chip, the cartridge comprising:

an ink cartridge housing having walls defining the exterior of the cartridge for enclosing a supply of ink;

one of the walls having an aperture formed therein to provide an opening through or within said one wall;

a pocket-like structure formed in said one wall and or on an inside surface of said one wall, the pocket-like structure being formed about the aperture;

a substrate including a memory, chip received in the pocket-like structure, the substrate including at least one electrical contact including an electrical contact surface that faces the aperture so as to be facing outwardly of the cartridge and being accessible to a contact member external to the cartridge when the cartridge is mounted in a printer's cartridge receiving receptacle; and wherein the cartridge is formed by assembling two housing halves and wherein a structure forming a part of the pocket is provided to cooperate with an edge configuration of the substrate so that the two housing halves are blocked from being mated when the substrate is incorrectly received in the pocket-like structure.

4. A method of assembling a memory chip into an ink cartridge, the method comprising:

providing ink cartridge housing halves each having walls defining the exterior of the cartridge and internal facing walls for defining a cavity for supporting a supply of ink, each of the housing halves having a wall having an aperture formed therein to provide an opening in said one wall, a pocket-like structure formed within each said one wall and/or on an inside surface of each said one wall, the pocket-like structure being formed about the aperture;

inserting a substrate including a memory chip into the pocket-like structure of each said one wall, the substrate including at least one electrical contact that faces the aperture so as to be accessible to a contact member external to the cartridge when the cartridge is mounted into a cartridge receiving receptacle associated with an ink jet printer; and assembling the housing halves with the substrate positioned in the pocket-like structure to form the cavity and to support the memory chip so that the electrical contact of the substrate is accessible to the external contact member when inserted into tile receptacle and wherein the substrate includes an edge having a chamfer formed therein.

5. The method of claim 4 and wherein the assembly of the housing halves provides for self-locating of the substrate within the pocket-like structure without need for a press fit of the substrate within the pocket-like structure.

6. The method of claim 4 and wherein the assembly of the housing halves provides for self-locating of the substrate within the pocket-like structure without need for correct press fit of the substrate within the pocket-like structure.

7. A method of assembling a memory chip into an ink cartridge. the method comprising:

providing ink cartridge housing halves each having walls defining the exterior of the cartridge and internal facing walls for defining a cavity for supporting a supply of ink, each of the housing halves hating one w,all having an aperture formed therein to provide an opening in said one wall, a pocket-like structure formed within each said one wall and/or on an inside surface of each said one wall, the pocket-like structure being formed about the aperture;

inserting a substrate including a memory chip into the pocket-like structure of each said one wall. the substrate including at least one electrical contact that faces the aperture so as to be accessible to a contact member external to the cartridge when the cartridge is mounted into a cartridge receiving receptacle associated with an ink jet printer; and assembling the housing halves with the substrate positioned in the pocket-like structure to form the cavity and to support the memory chip so that the electrical contact of the substrate is accessible to the external contact member when inserted into the receptacle and wherein the substrate includes a surface configuration that cooperates with a surface in the pocket- like structure to prevent wrong way insertion of the substrate within the pocket-like structure.

8. The method of claim 7 and wherein the assembly of the housing halves provides for self-locating of the substrate within the pocket-like structure without need for correct press fit of the substrate within the pocket-like structure.

9. The method of claim 8 and wherein an ink bag is enclosed within the cartridge when the housing halves are assembled.

10. The method of claim 9 and wherein the substrate includes an edge having a chamfer formed therein.

11. The method of claim 7 and wherein each housing half includes part of a top wall, part of a bottom wall, a complete side wall and part of two other side walls, and each housing half further includes. on an internal surface of the respective bottom wall and/or in the bottom wall, part of the pocket-like structure so that when the two housing halves forming the cartridge housing are assembled together the substrate is trapped within the pocket-like structure formed by the two housing halves.

12. An ink cartridge adapted to support a memory chip, the cartridge comprising:

an ink cartridge housing having walls defining the exterior of the cartridge for enclosing a supply of ink;

one of the walls having an aperture formed therein to provide an opening, on an exterior surface of the said one wall;

a pocket-like structure formed on an inside surface of said one wall and or in said one wall, the pocket-like structure being formed about the aperture to allow a substrate including a memory chip to be supported in the pocket-like structure with at least one electrical contact on the substrate allowed to face the aperture so as to be accessible to a contact member external to the cartridge when the cartridge is mounted in a printer's cartridge receiving receptacle, and wherein a surface in the pocket-like structure is complementary to a chamfer formed on an edge of the substrate to receive the chamfer.

13. A pair of ink cartridge housing halves adapted when mated together to form an ink cartridge and enclose a space for receiving a supply of ink and to support a memory chip, each of the housing halves comprising:

walls defining the exterior of the cartridge for enclosing the space;

one of the walls having an aperture formed therein to provide an opening in said one wall;

a pocket-like structure formed in said one wall and/or on an inside surface of said one wall, the pocket-like structure being formed about the aperture to allow a substrate including a memory chip to be supported in the pocket-like structure with at least one electrical contact on the memory chip allowed to face the aperture so as to be accessible to a contact member external to the cartridge when the substrate is mounted in the cartridge, and when the cartridge halves are mated together and when the cartridge is mounted in a printer's cartridge receiving receptacle; and wherein one of the housing halves has a surface in the pocket-like structure that is complementary to a chamfer formed on an edge of the substrate to receive the chamfer portion of the substrate.

14. An ink cartridge incorporating a memory chip, the cartridge comprising:

an ink cartridge housing having a top wall, a bottom wall and plural side walls defining the exterior of the cartridge for enclosing a supple of ink;

the bottom wall having an aperture formed therein to provide an opening through the exterior surface of the bottom wall;

a pocket-like structure formed within the bottom wall and/or on an inside surface of the bottom wall, the pocket-like structure being formed about the aperture; and a substrate including the memory chip received in the pocket-like structure, the substrate including at least one electrical contact that includes an electrical contact surface that faces the aperture so as to be facing outwardly of the cartridge and being accessible to a contact member external to the cartridge when the cartridge is mounted in a printer's cartridge receiving receptacle and wherein the electrical contact is circular and has a diameter of about ¼ of an inch.

15. An ink cartridge incorporating a memory chip, the cartridge comprising:

an ink cartridge housing having a top wall, a bottom wall and plural side walls defining the exterior of the cartridge for enclosing a supply of ink;

the bottom wall having an aperture formed therein to provide an opening through the exterior surface of the bottom wall;

a pocket-like structure formed within the bottom wall and/or on an inside surface of the bottom wall, the pocket-like structure being formed about the aperture;

a substrate including the memory chip received in the pocket-like structure, the substrate including at least one electrical contact that includes an electrical contact surface that faces the aperture so as to be facing outwardly of the cartridge and being accessible to a contact member external to the cartridge when the cartridge is mounted in a printer's cartridge receiving receptacle; and wherein the electrical contact is of an area equivalent to a circle having a diameter of about ¼ of an inch.

16. The cartridge of claim 15 and wherein the substrate comprises a relatively rigid circuit board and the pocket-like structure includes walls which locate the circuit board in the cartridge.

17. The cartridge of claim 16 and wherein the cartridge housing is formed by mating two housing halves, each housing half including part of the top wall, part of the bottom wall, a complete side wall and part of two other side walls of the plural side walls, and each housing half further including in and/or on an internal surface of the respective bottom wall part of the pocket-like structure so that when the two housing halves forming the cartridge housing are mated the circuit board is trapped within the pocket-like structure formed by the two housing halves.

18. The cartridge of claim 17 and wherein a chamfer is formed along an edge of the circuit board and the pocket-like structure includes an edge receiving surface with a complementary shape for receiving the edge with the chamfer for proper seating in the pocket-like structure and wherein the edge receiving surface is configured to block proper seating of the circuit board within the pocket-like structure when a different edge of the circuit board is attempted to be inserted into the cartridge so that the two housing halves are blocked from being mated when the circuit board is incorrectly received in the pocket-like structure.

19. The cartridge of claim 1 and wherein the at least one electrical contact comprises two electrical contacts that are located on the circuit board and face the aperture, and the aperture in the bottom wall is sufficiently large to expose both contacts so that each electrical contact is accessible to a respective electrical contact member external to the cartridge when the cartridge is mounted in the cartridge receiving receptacle, and wherein each housing half forms a part of the aperture.

20. The cartridge of claim 15 and wherein a chamfer is formed along an edge of the substrate and the pocket-like structure includes an edge receiving surface with a complementary shape for receiving the edge with the chamfer for proper seating in the pocket-like structure and wherein the edge receiving surface is configured to block proper seating of the substrate within the pocket-like structure when a different edge of the substrate is attempted to be inserted into the cartridge.

21. The ink cartridge of claim 15 and wherein a surface in the pocket-like structure is complementary to a chamfer formed on an edge of the substrate to receive the chamfer.

22. An ink cartridge incorporating a memory chip, the cartridge comprising:

an ink cartridge housing having walls defining the exterior of the cartridge for enclosing a supply of ink;

one of the walls having an aperture formed therein to provide an opening through or within said one wall;

a pocket-like structure formed in said one wall and,or on an inside surface of said one wall, the pocket-like structure being formed about the aperture; and a substrate including a memory chip received in the pocket-like structure, the substrate including at least one electrical contact including an electrical contact surface that faces the aperture so as to be facing outwardly of the cartridge and being accessible to a contact member external to the cartridge when the cartridge is mounted in a printer's cartridge receiving receptacle; and wherein the electrical contact is circular and has a diameter of about ¼ of an inch.

23. An ink cartridge incorporating a memory chip, the cartridge comprising:

an ink cartridge housing having walls defining the exterior of the cartridge for enclosing a supply of ink:

one of the walls having an aperture formed therein to provide an opening through or within said one wall;

a pocket-like structure formed in said one wall and/or on an inside surface of said one wall, the pocket-like structure being formed about the aperture; and a substrate including a memory chip received in the pocket-like structure, the substrate including at least one electrical contact including an electrical contact surface that faces the aperture so as to be facing outwardly of the cartridge and being accessible to a contact member external to the cartridge when the cartridge is mounted in a printer's cartridge receiving receptacle; and wherein the electrical contact is of an area equivalent to a circle having a diameter of about ¼ of an inch.

24. The ink cartridge of claim 23 and wherein a surface in the pocket-like structure is complementary to a chamfer formed on an edge of the substrate to receive the chamfer portion of the substrate.

* * * * *